US011745319B2

(12) United States Patent
Beckwith et al.

(10) Patent No.: US 11,745,319 B2
(45) Date of Patent: Sep. 5, 2023

(54) TORQUE WRENCH WITH IMPROVED HANDLE AND/OR ADJUSTER

(71) Applicant: APEX BRANDS, INC., Apex, NC (US)

(72) Inventors: Jonathan Siebert Beckwith, Raleigh, NC (US); Ian Cunningham, Charlotte, NC (US); Brian Butler, Charlotte, NC (US); Paul Stephen Steinweg, Lititz, PA (US)

(73) Assignee: APEX BRANDS, INC., Apex, NC (US)

( * ) Notice: Subject to any disclaimer, the term of this patent is extended or adjusted under 35 U.S.C. 154(b) by 402 days.

(21) Appl. No.: 17/052,911

(22) PCT Filed: May 23, 2019

(86) PCT No.: PCT/US2019/033725
§ 371 (c)(1),
(2) Date: Nov. 4, 2020

(87) PCT Pub. No.: WO2019/226882
PCT Pub. Date: Nov. 28, 2019

(65) Prior Publication Data

US 2021/0069877 A1 Mar. 11, 2021

Related U.S. Application Data

(60) Provisional application No. 62/676,421, filed on May 25, 2018.

(51) Int. Cl.
*B25B 23/142* (2006.01)
*B25B 23/16* (2006.01)

(52) U.S. Cl.
CPC ..... *B25B 23/142* (2013.01); *B25B 23/16* (2013.01)

(58) Field of Classification Search
CPC ..... B25B 23/142; B25B 23/1422; B25B 23/1405; B25B 23/141; B25B 23/1427; B25B 23/16
See application file for complete search history.

(56) References Cited

U.S. PATENT DOCUMENTS 2,731,865 A 1/1956 Woods
2,918,834 A 12/1959 Cranford
(Continued)

FOREIGN PATENT DOCUMENTS

CN 203779401 U 8/2014
EP 2554330 A2 2/2013
(Continued)

OTHER PUBLICATIONS

Second Office Action (with translation) issued in corresponding Chinese Application No. 201980034356.8 dated Jul. 5, 2022, all enclosed pages cited.
(Continued)

*Primary Examiner* — David B. Thomas
(74) *Attorney, Agent, or Firm* — BURR & FORMAN LLP

(57) ABSTRACT

A torque wrench may include a head having a driving member configured to be operably coupled to a socket, a handle, a lever arm operably coupled to the head and the handle at respective opposing ends thereof, and a torque adjuster configured to enable a torque setting of the torque wrench to be adjusted. The torque adjuster may include a fixed member affixed to the lever arm and a movable member operably coupled to the fixed member. The handle may include a first end cap at a distal end thereof relative to the head and a second end cap at a proximal end thereof relative to the head, the second end cap being disposed proximate to the movable member.

20 Claims, 5 Drawing Sheets

(56) References Cited

U.S. PATENT DOCUMENTS

| | | | | | |
|---|---|---|---|---|---|
| 3,772,942 | A | | 11/1973 | Grabovac | |
| 4,655,104 | A | | 4/1987 | Blattner | |
| 4,709,602 | A | * | 12/1987 | Grabovac | B25B 23/16 81/177.1 |
| 5,435,190 | A | * | 7/1995 | Jansson | B25B 23/1427 73/862.23 |
| 6,807,885 | B2 | | 10/2004 | Loper | |
| 7,631,583 | B2 | * | 12/2009 | Hsieh | B25B 23/1422 81/479 |
| 8,495,935 | B2 | * | 7/2013 | Mountz | B25B 23/1427 81/473 |
| 8,763,500 | B2 | * | 7/2014 | Mountz | B25B 23/1427 81/473 |
| 9,032,848 | B2 | * | 5/2015 | Hsieh | B25B 23/1427 81/483 |
| 9,561,583 | B2 | * | 2/2017 | Hsieh | B25B 23/1422 |
| 9,700,999 | B2 | | 7/2017 | Hsieh | |
| 10,179,396 | B2 | * | 1/2019 | Hsieh | G01L 25/003 |
| 11,052,517 | B2 | * | 7/2021 | Hsieh | B25B 23/0007 |
| 2013/0228053 | A1 | | 9/2013 | Chen | |
| 2014/0338419 | A1 | * | 11/2014 | Hsieh | G01L 25/003 81/477 |

FOREIGN PATENT DOCUMENTS

| | | | | | |
|---|---|---|---|---|---|
| FR | 2869253 | A3 | * | 10/2005 | B25B 23/142 |
| GB | 519815 | A | * | 4/1940 | B25B 23/142 |
| GB | 2435628 | A | | 9/2007 | |

OTHER PUBLICATIONS

Office Action from Chinese Application No. 201980034356.8 dated Nov. 24, 2021, all pages cited in its entirety.

International Search Report and Written Opinion from related international application No. PCT/US2019/033725 dated Aug. 27, 2019, all pages cited in its entirety.

Third Office Action (with translation) issued in corresponding Chinese Application No. 201980034356.8 dated Jan. 5, 2023, all enclosed pages cited.

* cited by examiner

TORQUE WRENCH WITH IMPROVED HANDLE AND/OR ADJUSTER

CROSS REFERENCE TO RELATED APPLICATIONS

This application claims priority to U.S. application No. 62/676,421 filed May 25, 2018, the entire contents of which are hereby incorporated by reference in its entirety.

TECHNICAL FIELD

Example embodiments generally relate to hand tools and, in particular, relate to a torque wrench with an improved handle and/or an improved torque adjuster.

BACKGROUND

Hand tools are commonly used across all aspects of industry and in the homes and workshops of consumers. Hand tools are employed for multiple applications including, for example, fastener tightening, component joining, and/or the like. For some fastener tightening applications, a highly accurate torque setting is either preferred or required. To provide the ability to accurately apply torque, a class of hand tools referred to generally as torque wrenches have been developed. Torque wrenches are calibrated devices that enable the operator to know when a particular torque is reached. The means by which the operator is informed of the fact that the particular torque has been reached can vary with corresponding different types of torque wrenches.

For one particular type of torque wrench, an audible and/or tactile "click" is generated to inform the operator that the particular torque has been reached. In many cases, a spring extends through the lever arm of the torque wrench to apply pressure to a ball that interfaces with the ratchet head of the torque wrench. Until the particular torque is reached, the ball is retained (by the force of the spring) in a socket or depression that enables torque to be applied along the lever arm of the torque wrench and through the ratchet head. However, when the particular torque is reached, the spring force on the ball is overcome, and the ball is allowed to slip out of the socket in which it was retained, and into another socket, thereby providing the audible and/or tactile "click" to let the operator know that the particular torque has been reached.

Torque wrenches of this type often provide the operator with the ability to select the particular torque via an adjuster that is provided on the handle of the torque wrench. Often, the operator turns the handle relative to the lever arm to adjust the tension setting of the spring inside the lever arm. Such an adjuster is generally accurate, particularly when maintained within calibration. However, for a typical torque wrench construction, the ability to interface with the adjuster can be poor, and the handle is not properly designed for optimal hand positioning and tool usage.

BRIEF SUMMARY OF SOME EXAMPLES

Some example embodiments may enable the provision of an improved interface for the adjuster and/or an improved handle that facilitates optimal positioning of the hand of the operator.

In an example embodiment, a torque wrench may be provided. The torque wrench may include a head having a driving member configured to be operably coupled to a socket, a handle, a lever arm operably coupled to the head and the handle at respective opposing ends thereof, and a torque adjuster configured to enable a torque setting of the torque wrench to be adjusted. The torque adjuster may include a fixed member affixed to the lever arm and a movable member operably coupled to the fixed member. The handle may include a first end cap at a distal end thereof relative to the head and a second end cap at a proximal end thereof relative to the head, the second end cap being disposed proximate to the movable member.

In another example embodiment, a torque wrench may be provided. The torque wrench may include a head having a driving member configured to be operably coupled to a socket, a handle, a lever arm operably coupled to the head and the handle at respective opposing ends thereof, and a torque adjuster configured to enable a torque setting of the torque wrench to be adjusted. The torque adjuster may include a fixed member affixed to the lever arm and a movable member operably coupled to the fixed member. The fixed member and the movable member may each have a first color on a periphery thereof. The fixed member may include reference markings etched therein and the movable member may include incremental markings etched therein. The reference markings and the incremental markings may be provided in a second color that is different than the first color.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1B:
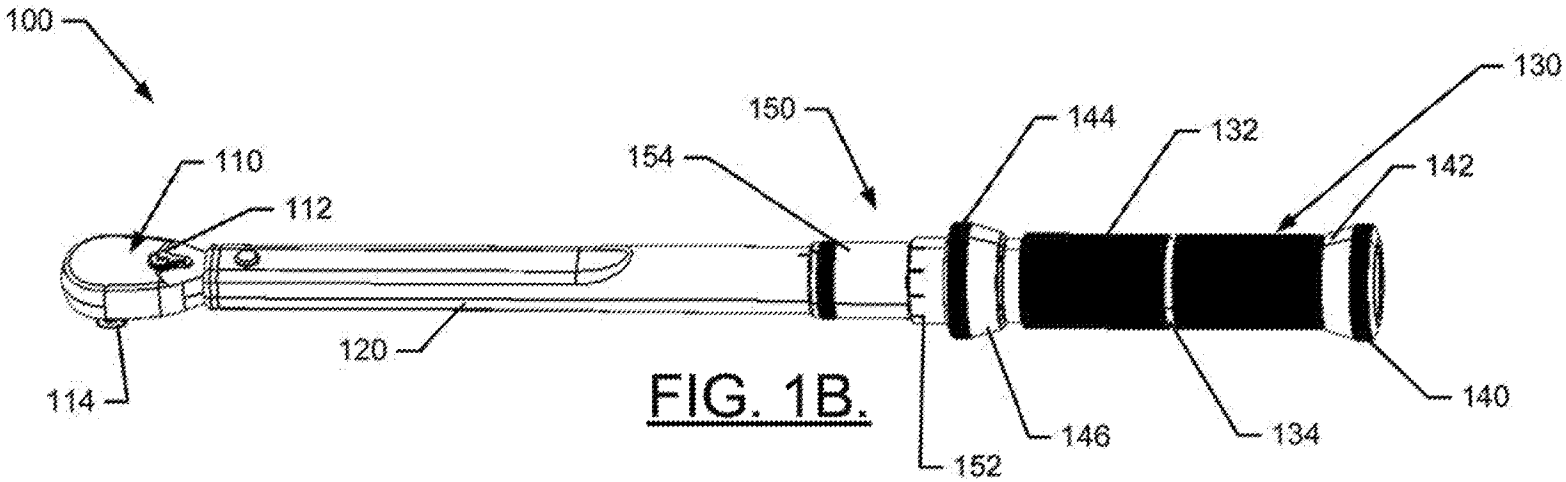
FIG. 1B illustrates a different perspective view of the torque wrench of FIG. 1A according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Figure 1A:
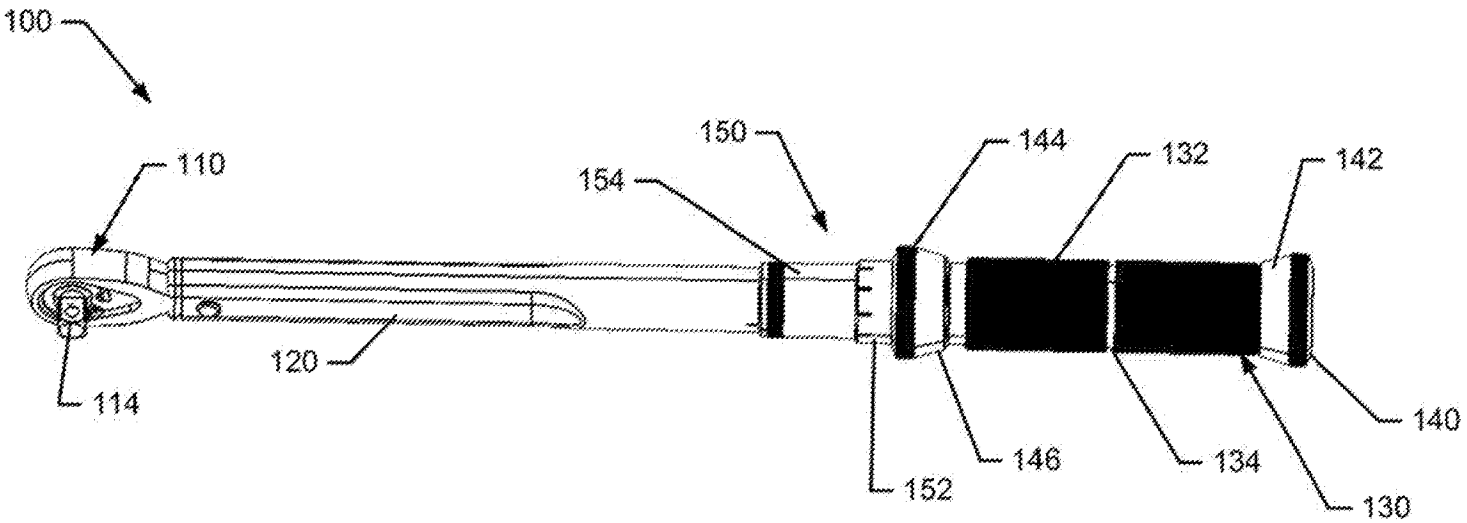
FIG. 1A illustrates a perspective view of a torque wrench according to an example embodiment.
Figure 2:
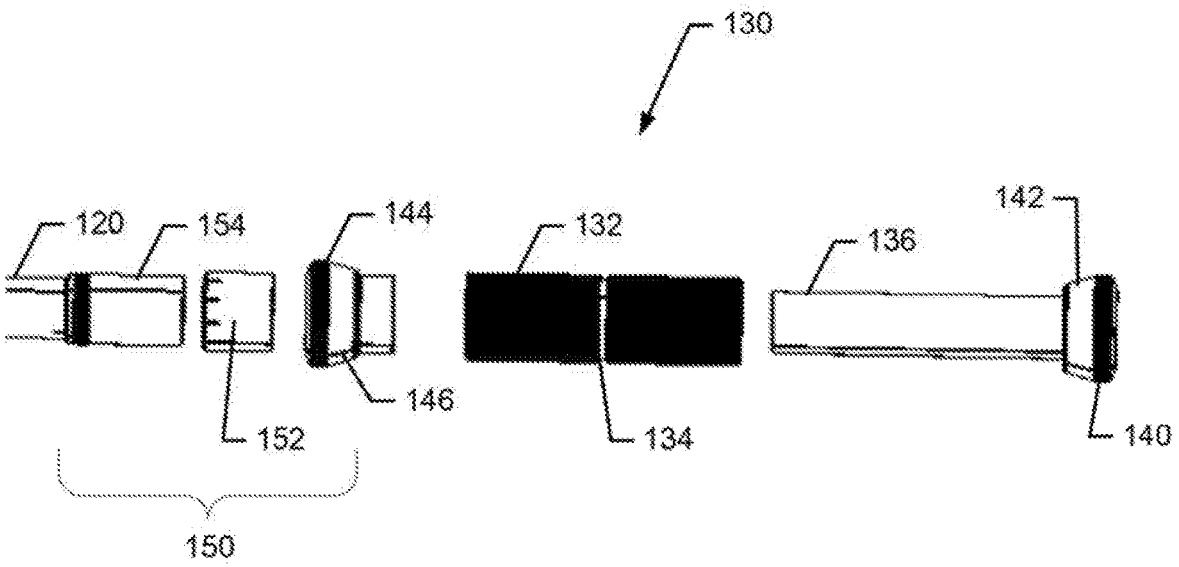
FIG. 2 illustrates an exploded view of the handle and adjuster of the torque wrench according to an example embodiment.

As indicated above, some example embodiments may relate to improvements to the design of a torque wrench 100. FIGS. 1-5 show various views or portions of one such example embodiment. In this regard, FIGS. 1A and 1B illustrate different perspective views of a hand tool (e.g., the torque wrench 100) having improvements associated with an example embodiment. FIG. 2 illustrates an exploded view of the torque wrench 100. As shown in FIGS. 1A, 1B and 2, the torque wrench 100 may include a head 110 (e.g., a ratchet head) that may include a direction selector 112 and a driving member 114. The direction selector 112 may be used to select which direction torque can be applied versus which direction torque is not applied and ratcheting is enabled. The driving member 114 may interface with a selected socket that actually interfaces with the fastener that is being torqued. Various internal components of the head 110 may control the ratcheting capability, and are outside the scope of this disclosure. However, it should also be appreciated that example embodiments could be practiced in a context in which ratcheting is either not desired or not enabled.

The head 110 may be operably coupled to a first end of a lever arm 120. A second end of the lever arm 120 may be operably coupled to a handle assembly or handle 130 of the torque wrench 100. The head 110 may have a substantially flat profile on both front and back faces thereof. Meanwhile, the lever arm 120 may maintain a width and flat profile that substantially matches that of the head 110 as the lever arm 120 extends away from the head 110 to improve accessibility of the head 110 and lever arm 120 into certain locations or proximate to potential obstructions. The lever arm 120 may further include a transition from the flat profile to a round (or substantially round) profile as the handle 130 is approached. The handle 130 may include a grip portion 132. The grip portion 132 may be made of aluminum or some other material that may have, for example, a knurled outer periphery that enhances the ability of the operator to grip the handle 130 effectively. Since the accuracy of the torque wrench 100 is at least partly dependent upon an assumption as to the distance between the origin of the force applied and the point of application of the force, it is important to direct the operator to a consistent grip location. In an example embodiment, a guide trench 134 may be disposed substantially at a center of the grip portion 132 (e.g., midway between longitudinal ends of the grip portion 132). By placing the middle finger in the guide trench, the distance between the origin of the force applied and the point of application of the force may be maintained as consistently as possible, and the accuracy of the torque wrench 100 may be improved.

Figure 3:
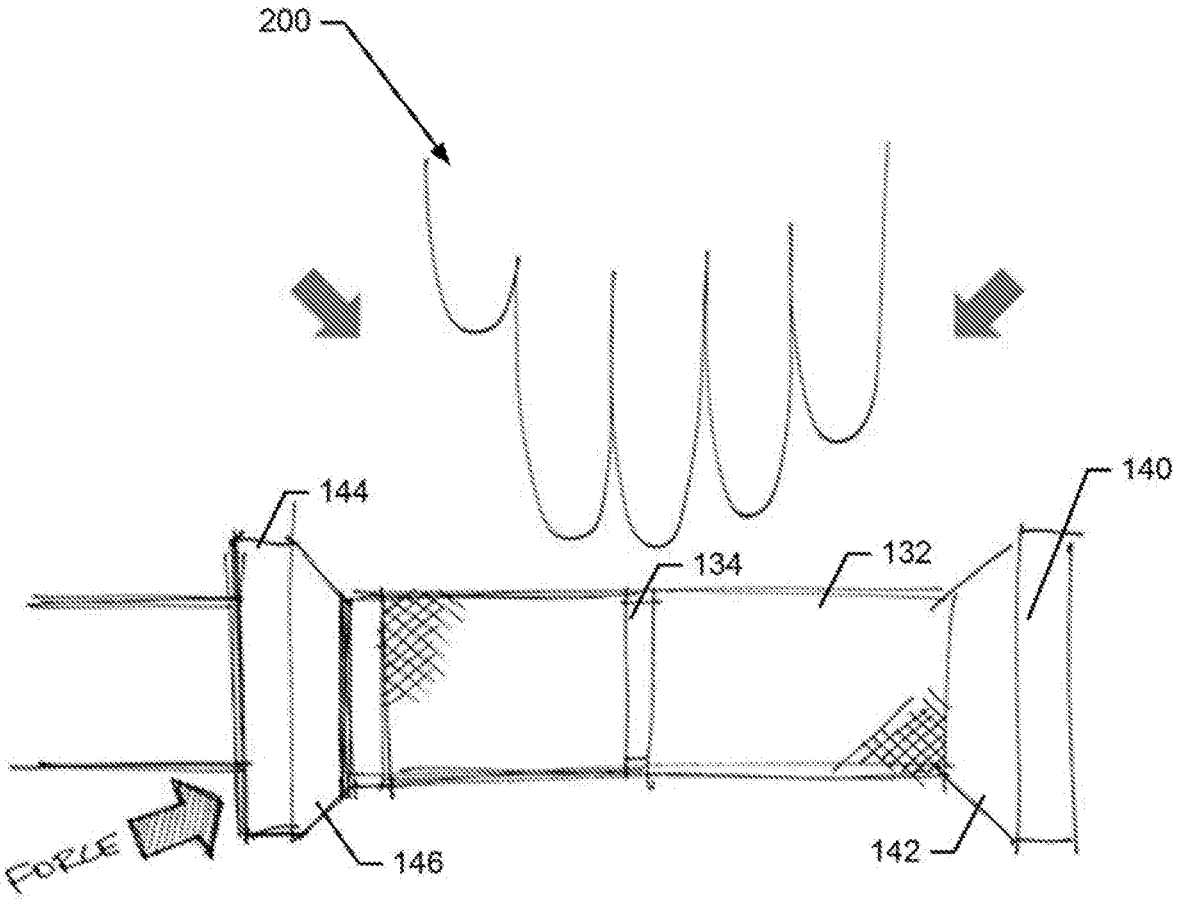
FIG. 3 illustrates a side view of the handle of the torque wrench to demonstrate optimal hand positioning and structures of the torque wrench that facilitate the same according to an example embodiment.
Figure 4:
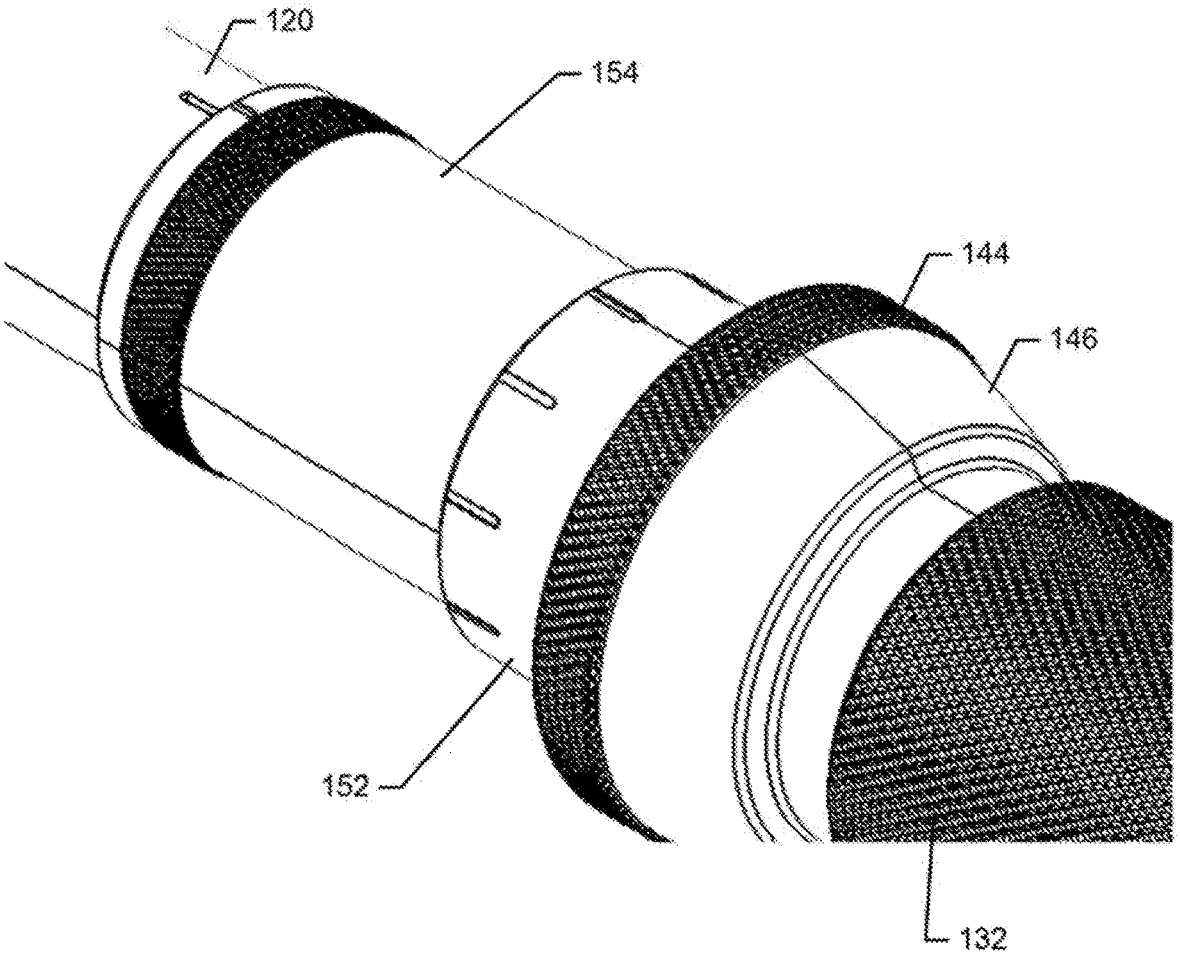
FIG. 4 illustrates a close-up, perspective view of the adjuster of the torque wrench according to an example embodiment.

As shown in FIG. 2, the grip portion 132 may be disposed over a handle rod 136 that may extend from a first end cap 140 to a second end cap 144. The first end cap 140 may be disposed at a distal end of the torque wrench 100 relative to the head 110, and the second end cap 144 may be disposed between the handle 130 and the lever arm 120. In an example embodiment, each of the first and second end caps 140 and 144 may have a diameter that is larger than the diameter of other portions of the handle 130 (e.g., including the grip portion 132 in particular). Moreover, the first end cap 140 may include a first guide surface 142 disposed adjacent to one end of the grip portion 132, and the second end cap 144 may include a second guide surface 146 disposed adjacent to the opposite end of the grip portion 132. Accordingly, as shown in FIG. 3, the first and second guide surfaces 142 and 146 may face each other and be sloped to form a transition from the larger outer diameter of the first and second end caps 140 and 144, respectively, to the diameter of the grip portion 132. The sloping of the first and second guide surfaces 142 and 146 toward each other may therefore allow a hand 200 of the operator to be directed to an optimal grip location on the grip portion 132. In particular, to the extent the hand 200 initially reaches too far forward or rearward, the slope of the first or second guide surface 142 or 146 will tend to slide the hand 200 in the appropriate direction either rearward or forward along the grip portion 132. It is then more likely that the operator's middle finger will find the guide trench 134.

Of note, conventional torque wrenches tend to have a smoother transition from the grip portion to the lever arm. This smoother transition can result in the operator's hand sliding forward on the torque wrench, or the operator grabbing too much of the end of the torque wrench. Not only can accuracy be impacted by the slide forward or rearward, but other unwanted results can also occur. For example, it is very often the case that the torque setting is adjusted at a portion just forward of the grip portion, and a lock can be provided either just forward or just rearward of the grip portion as well. Thus, for a conventional design, the misplacement of the operator's hand could either change the torque setting or unlock the torque adjuster. As such, the first and second guide surfaces 142 and 146 serve an important purpose relative to maintaining proper operation of the torque wrench. In this regard, the first and second guide surfaces 142 and 146 represent particular structures that have multifunctional advantages (i.e., relative to providing hand positioning and setting preservation). In an example embodiment, the second end cap 144 may also serve an additional function of acting as the locking member for the adjuster 150, as discussed in greater detail below.

In some cases, an outer periphery of one or both of the first and second end caps 140 and 144 may also have knurled, aluminum finish. This finish may enhance the ability of the operator to grip the outer periphery. In an example in which the second end cap 144 acts as the locking member for the adjuster 150, the operator may be able to improve his/her ability to grip and turn the locking member due to the larger diameter of the second end cap 144 and the knurled finish. In some cases, the knurled finish on the second end cap 144 coupled with the sharp angular transition from the adjuster 150 to the second end cap 144 may allow the user to more easily grip the second end cap 144. Force may therefore be more easily applied to the second end cap 144 to initiate locking of the adjuster 150.

As shown in FIGS. 1A, 1B, 2 and 4, the adjuster 150 of an example embodiment may be located between the handle 130 and the lever arm 120. The adjuster 150 may include a movable member 152 and a fixed member 154 that are operably coupled to each other. Meanwhile, the fixed member 154 may also be operably coupled to the lever arm 120. The movable member 152 and the fixed member 154 may each by substantially cylindrical in shape, with hollow centers. In an example embodiment, the movable member 154 may have an internal periphery that is slightly larger in diameter than a diameter of the external periphery of the fixed member 154 to allow the movable member 152 to rotate around at least a portion of the fixed member 154. The fixed member 154 may have an internal periphery that is slightly larger in diameter than a diameter of an external periphery of a distal end of the lever arm 120 relative to the head 110. This may enable the fixed member 154 to be slid over (and affixed to) the distal end of the lever arm 120.

In some cases, the second end cap 144 may also be a portion of the adjuster 150 if the second end cap 144 is used to lock the adjuster 150 (e.g., by locking the movable member 152 to prevent movement thereof). The second end cap 144 may therefore act as a pull collar allowing movement of the second end cap 144 away from the movable member 152 to unlock movement thereof. The moveable member 152 may be operably coupled to the spring that is within the lever arm 120. In this regard, by moving the movable member 152, an adjustable screw may move within the lever arm 120 to adjust tension that the spring places on the ball to attempt to keep the ball in the socket as described above. The fixed member 154 may have one or more sets of reference marks corresponding to respective values of torque in corresponding units of torque. These reference marks may become aligned with respective different incremental markings disposed around the external periphery of the movable member 152 responsive to rotation of the movable member 152. In some cases, the reference marks on the fixed member 154 may include increments of ten units and the incremental markings disposed around the external periphery of the movable member 152 may be ten increments of a single unit each (e.g., from 0 to 9). Thus, for example, if the 0 incremental marking on the movable member 152 is aligned with the reference marking for 50 units (e.g., lb-ft), then one complete rotation of the movable member 152 may cause the 0 incremental marking on the movable member 152 to align with the reference marking for either 40 units or 60 units (depending on the direction of rotation). Other relationships between the reference marks and the incremental markings may also be defined depending on the range and configuration of the torque wrench 100.

One common method for providing the incremental markings and reference marks is to laser etch the reference marks on the lever arm 120 proximate to the movable member 152 instead of providing a separate fixed member. However, this method results in etch marks in a metallic surface that can be very difficult to read and align. Accordingly, an advantage provided by employing the fixed member 154 as a separate component that can be affixed to the distal end of the lever arm 120 is that the fixed member 154 can employ a color scheme that make the markings and numbers easier to read. In this regard, for example, the fixed member 154 may be black anodized aluminum that is laser etched with text including white reference markings provided thereon. The white text may include numbers and reference markings that provide a large contrast with the black color of the fixed member 154 and may therefore be easy to read. The same scheme could be followed on the movable member 152. For example, the movable member 152 may be made of black anodized aluminum, and the text may be laser etched, white text and incremental markings. However, it should be appreciated that any color scheme that provides good contrast therebetween could be used in alternative embodiments.

The second end cap 144 may be moved (e.g., by either being rotated or pulled in the direction of the force arrow in FIG. 3) between a locked position and an unlocked position. When the second end cap 144 is in the locked position, movement of the movable member 152 may be inhibited. When the second end cap 144 is in the unlocked position, movement of the movable member 152 may be permitted and such movement may correspondingly adjust the tension of the spring. While the movable member 152 is rotated, the alignment of the reference markings and the incremental markings is changed, but should be much more easy to appreciate than conventional markings that offer little contrast between the background and such markings.

Figure 5:
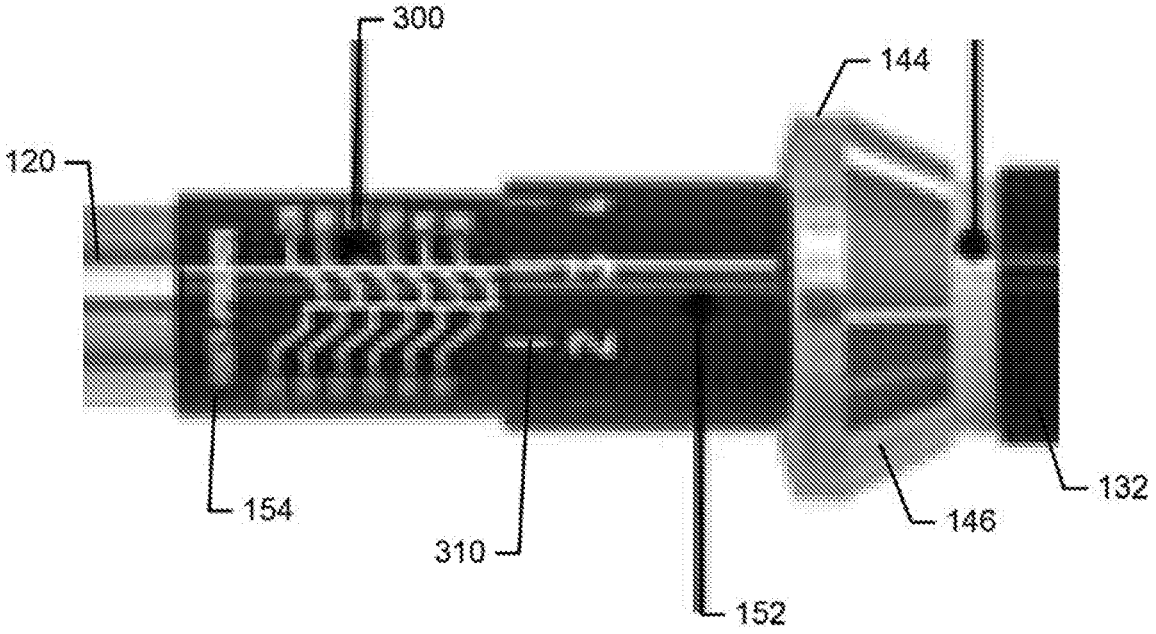
FIG. 5 illustrates a side view of scales of the adjuster to demonstrate improved readability of the scales according to an example embodiment.

FIG. 5 illustrates an example of reference markings 300 etched in white provided on the fixed member 154, which is otherwise black (e.g., black anodized aluminum). The reference markings 300 (and corresponding text) is easily visible in this example. Meanwhile, the incremental markings 310 (also in white) on the movable member 152 are also very easy to see in this example due to the great contrast in colors between the color of the fixed member 154 and the movable member 152 being so different than the color of the text associated with the reference markings 300 and the incremental markings 310. Thus, it should be appreciated that any colors that provide great contrast could be used assuming the materials of the respective components can be manufactured with such colors.

As can be appreciated from the example of FIGS. 1A-5, example embodiments may define a hand tool (i.e., a torque wrench) with various unique features. The torque wrench may include a head having a driving member configured to be operably coupled to a socket, a handle, a lever arm operably coupled to the head and the handle at respective opposing ends thereof, and a torque adjuster configured to enable a torque setting of the torque wrench to be adjusted. The torque adjuster may include a fixed member affixed to the lever arm and a movable member operably coupled to the fixed member. The handle may include a first end cap at a distal end thereof relative to the head and a second end cap at a proximal end thereof relative to the head, the second end cap being disposed proximate to the movable member. In addition or as an alternative to including the end caps, the fixed member and the movable member may each have a first color on a periphery thereof. The fixed member may include reference markings etched therein and the movable member may include incremental markings etched therein. The reference markings and the incremental markings may be provided in a second color that is different than the first color.

The torque wrench and/or its components may include a number of modifications, augmentations, or optional additions, some of which are described herein. These modifications, augmentations or optional additions may be included in any combination. For example, the torque wrench may further be modified such that the first color is black and the second color is white. In some cases, the first and second end caps may each have a diameter that is larger than a diameter of the handle. In an example embodiment, the first end cap may include a first guide surface and the second end cap may include a second guide surface. The first and second guide surfaces may slope from the diameter of the first and second end caps to the diameter of the handle. In some cases, the first and second guide surfaces face each other from opposite ends of the handle. In an example embodiment, the handle may include a grip portion disposed between the first and second end caps. The grip portion may include a knurled outer periphery over a majority of a surface thereof. The grip portion may include a guide trench disposed to extend annularly about a longitudinal midpoint of the grip portion. In some cases, the grip portion, the fixed member and the movable member may each be formed of black anodized aluminum. In an example embodiment, the second end cap may be movable (e.g., by rotating or pulling) between a locked position and an unlocked position such that, when the second end cap is in the locked position, movement of the movable member is inhibited, and when the second end cap is in the unlocked position, movement of the movable member is enabled and such movement correspondingly adjusts tension of a spring disposed in the lever arm to interface with the head.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A torque wrench comprising:

a head including a driving member configured to be operably coupled to a socket;

a handle;

a lever arm operably coupled to the head and the handle at respective opposing ends thereof; and a torque adjuster configured to enable a torque setting of the torque wrench to be adjusted, wherein the torque adjuster comprises a fixed member affixed to the lever arm and a movable member operably coupled to the fixed member, the fixed member and the movable member each having a first color on a periphery thereof, wherein the fixed member includes reference markings etched therein and the movable member includes incremental markings etched therein, and wherein the reference markings and the incremental markings are provided in a second color that is different than the first color, wherein the first color, the second color, and a surface of the lever arm visually contrast for readability of the reference markings and the incremental markings.

2. The torque wrench of claim 1, wherein the first color is black and the second color is white.

3. The torque wrench of claim 1, wherein the fixed member is a separate component form the lever arm and is affixed to the lever arm.

4. The torque wrench of claim 3, wherein the movable member is substantially cylindrical with a hollow center having an internal diameter that is larger than an external diameter of an external periphery of the fixed member to permit rotation of the movable member around at least a portion of the fixed member.

5. The torque wrench of claim 1, wherein the handle comprises a first end cap at a distal end thereof relative to the head and a second end cap at a proximal end thereof relative to the head;

wherein the first and second end caps each have a diameter that is larger than a diameter of the handle.

6. The torque wrench of claim 5, wherein the first end cap includes a first guide surface and the second end cap includes a second guide surface, the first and second guide surfaces sloping from the diameter of the first and second end caps to the diameter of the handle.

7. The torque wrench of claim 1, wherein the handle comprises a first end cap at a distal end thereof relative to the head and a second end cap at a proximal end thereof relative to the head;

wherein the handle comprises a grip portion disposed between the first and second end caps, where the grip portion comprises a knurled outer periphery over a majority of a surface thereof.

8. The torque wrench of claim 7, wherein the grip portion comprises a guide trench disposed to extend annularly about a longitudinal midpoint of the grip portion.

9. The torque wrench of claim 7, wherein the grip portion, the fixed member and the movable member are each formed of black anodized aluminum.

10. The torque wrench of claim 1, wherein the handle comprises an end cap at a proximal end of the handle relative to the head;

wherein the end cap is configured to move as a pull collar relative to the movable member between a locked position and an unlocked position such that, when the end cap is in the locked position, movement of the movable member is inhibited, and when the end cap is in the unlocked position, movement of the movable member is enabled to adjust a torque setting of the torque wrench.

11. A torque wrench comprising:

a head including a driving member configured to be operably coupled to a socket;

a handle;

a lever arm operably coupled to the head and the handle at respective opposing ends thereof; and a torque adjuster configured to enable a torque setting of the torque wrench to be adjusted, wherein the torque adjuster comprises a fixed member affixed to the lever arm and a movable member operably coupled to the fixed member, wherein the handle comprises a first end cap at a distal end thereof relative to the head and a second end cap at a proximal end thereof relative to the head, the second end cap being disposed proximate to the movable member, wherein the second end cap is configured to move as a pull collar relative to the movable member between a locked position and an unlocked position such that, when the second end cap is in the locked position, movement of the movable member is inhibited, and when the second end cap is in the unlocked position, movement of the movable member is enabled to adjust a torque setting of the torque wrench.

12. The torque wrench of claim 11, wherein the fixed member and the movable member each have a first color on a periphery thereof, wherein the fixed member includes reference markings etched therein and the movable member includes incremental markings etched therein, and wherein the reference markings and the incremental markings are provided in a second color that is different than the first color;

wherein the first color, the second color, and a surface of the lever arm visually contrast for readability of the reference markings and the incremental markings.

13. The torque wrench of claim 12, wherein the first color is black and the second color is white.

14. The torque wrench of claim 11, wherein the first and second end caps each have a diameter that is larger than a diameter of the handle.

15. The torque wrench of claim 14, wherein the first end cap includes a first guide surface and the second end cap includes a second guide surface, the first and second guide surfaces sloping from the diameter of the first and second end caps to the diameter of the handle.

16. The torque wrench of claim 15, wherein the first and second guide surfaces face each other from opposite ends of the handle.

17. The torque wrench of claim 11, wherein the handle comprises a grip portion disposed between the first and second end caps, where the grip portion comprises a knurled outer periphery over a majority of a surface thereof.

18. The torque wrench of claim 17, wherein the grip portion comprises a guide trench disposed to extend annularly about a longitudinal midpoint of the grip portion.

19. The torque wrench of claim 17, wherein the grip portion, the fixed member and the movable member are each formed of black anodized aluminum.

20. The torque wrench of claim 11, wherein the movable member is substantially cylindrical with a hollow center having an internal diameter that is larger than an external diameter of an external periphery of the fixed member to permit rotation of the movable member around at least a portion of the fixed member.

* * * * *